United States Patent [19]

Brouessard

[11] Patent Number: 4,668,547

[45] Date of Patent: May 26, 1987

[54] SURFACING FOR THE VERTICAL WATERPROOFING OR SEAL OF THE FACADES OF APARTMENT BLOCKS, INDUSTRIAL BUILDINGS AND INDIVIDUAL HOUSES

[75] Inventor: René Brouessard, Mauves-sur-Loire, France

[73] Assignee: Societe Anonyme dite: SICOF S.A., Nantes, France

[21] Appl. No.: 680,507

[22] Filed: Dec. 11, 1984

[30] Foreign Application Priority Data

Jul. 4, 1984 [EP] European Pat. Off. ..... 84401418.3

[51] Int. Cl.[4] ..... A61F 13/02

[52] U.S. Cl. ..... 428/40; 428/192; 428/193; 428/198; 428/202; 428/246; 428/284; 428/343; 428/354; 428/904.4

[58] Field of Search ..... 428/195, 198, 343, 354, 428/196, 192, 193, 202, 40, 904.4, 246, 284

[56] References Cited

U.S. PATENT DOCUMENTS 4,554,194 11/1985 Haas et al. ..... 428/198

FOREIGN PATENT DOCUMENTS 1284246 1/1962 France .
1394256 5/1975 United Kingdom .

*Primary Examiner*—James J. Bell
*Attorney, Agent, or Firm*—Sandler & Greenblum

[57] ABSTRACT

A waterproofing or sealing surfacing for the facade of a building comprises an armature of fibrous material, such as a woven fabric or non-woven tissue which is either glued or pasted by a resin onto the facade of the building. It presents, on its outwardly facing surface, a discontinuous layer with a relief area in the form of drops of water, which layer comprises dry resin droplets adhering to the surface of the armature and defining between them zones which are not covered by these droplets. On this layer, a thin layer of plastics material constituting a protective film adheres to the discontinuous layer formed by the dry resin droplets and is adapted to be easily detached from this layer at the moment of application of the surface on its support or of the layer of finish on the armature.

7 Claims, 6 Drawing Figures

SURFACING FOR THE VERTICAL WATERPROOFING OR SEAL OF THE FACADES OF APARTMENT BLOCKS, INDUSTRIAL BUILDINGS AND INDIVIDUAL HOUSES

BACKGROUND OF THE INVENTION

1. Technical Field of the Invention

The present invention relates to a surfacing for the vertical waterproofing or seal of the facades of apartment blocks, industrial buildings and individual houses, and to a process for manufacturing and using it.

2. Discussion of Prior Art

The present technique for waterproofing or sealing the vertical parts of a building consists in using an armature of glass or woven or non-woven synthetic fibers, in the form of strips of variable width, generally from 1 meter to 0.04 m, terminated by a border in the first case and by fringes obtained mechanically in the second case, along the longitudinal edges of the strips. After preparation of the support on which such an armature is to be applied, the latter is glued or pasted by complete impregnation with a diluted resin, the quantity on "pure" resin used being of the order of 1 kg/m$^2$. After drying of the woven or non woven armature glued to its support, a pigmented finish giving a smooth or embossed surface appearance is then applied. This complex gives remarkable results from the standpoint of elongation properties.

Such a process presents various drawbacks.

Firstly, there is the risk of one or more days work being destroyed by rain, especially in winter. In fact, the resins used for gluing this type of woven or non-woven surfacing are products in emulsion form which are water-soluble and therefore very sensitive to the rain. This risk is accentuated by the large amount of product deposited per square meter for gluing the woven or non-woven armature.

The dilution of the resin, provoked by the rain, eliminates any bond between the woven or non-woven armature and the support. Consequently, the whole surfacing collapses to the foot of the building, this involving not only redoing the surfacing, but also large-scale cleaning of the openings, woodworks, windows, etc . . . which become soiled as a result of the flow of diluted resin.

Another drawback presented by the surfacing with the non-woven armature is the appearance of barbs which emerge when a layer of finish is applied.

The barbs render smooth finishes difficult; they are detrimental to aesthetic appearance and retain dust from the atmosphere, leading to premature soiling of the facades treated after six months or a year in highly polluted regions.

SUMMARY OF THE INVENTION

It is an object of the present invention to overcome these drawbacks by providing a water proofing or sealing surfacing which is easy to employ which is, protected against the harmful effect of rain, and which insures a prolonged aesthetic effect.

To this end, this waterproofing or sealing surfacing for the facade of a building comprises an armature of fibrous material, such as a woven fabric or non-woven tissue, which is either glued or pasted by a resin onto the facade of the building the surfacing is characterized in that it presents, on its outwardly facing surface, a discontinuous layer with relief areas in the form of drops of water, comprising dry resin droplets adhering to the surface of the armature and defining between them zones not covered by these droplets, and, on this layer, a thin layer of plastic material constituting a protective film adhering to the discontinuous layer formed by the dry resin droplets and adapted to be easily detached from this layer at the moment of application of the surface onto its support or of the layer of finish onto the armature.

There exists between the droplets of resin non-impregnated portions which permit the passage of air when the armature is placed on the resin and consequently avoid air bubbles being caught between the armature and the support. It is therefore clear that this is an indispensable element for easy execution and good resistance of the surfacing over time.

The inner face, in contact with the support, of this woven or non-woven armature presents a fibrous appearance over its whole surface, the droplets of resin projected on the other face not passing through another indispensable element for easy execution and good adherence of the surfacing on the support.

The resin droplets distributed over the surface of the layer fix the fibers and consequently eliminate the appearance of the barbs at the moment of execution, making it possible to obtain finishes without sharp relief, thus avoiding premature soiling of the surfacing, and considerably improving its aesthetic appearance.

On this woven or non-woven armature, which is pre-impregnated with a resin distributed in droplets over its outer surface, there is applied a thin, colourless sheet, for example made of 0.03 millimeter thick polyethylene thick, projecting from each side of the armature by 2 cm.

For on-site operation, if the weather is fine, the protective film may be eliminated as the gluing of the armature advances; if there is a risk of rain, the polyethylene protective film is left in place, offering total protection for the armature impregnated with fresh resin.

When there is no more risk of rain, this protective film is eliminated very easily, before completing gluing of the armature with resin, and a smooth finish in the desired colour is thereafter applied.

This process enables the workmen to work without risk, especially in winter, of seeing their work ruined as mentioned above.

As seen hereinbefore, the surfacing is laid along a facade by adjacent strips having a width of one meter, for example, or less than a meter.

With this process it is possible to use widths of 2 meters with an appropriate apparatus for on-site laying.

For connection between the strips, fringes may be formed on each selvage of a strip. In other words, the fibers are drawn on the side, this thinning the edge and thus avoiding excess thickness. When the first strip is laid, the fibers are combed so as to extend them perpendicularly to the strip, the same being carried out for the fibers of the selvage of the adjacent strip. The fibers of the second strip, previously extended perpendicularly to its edge, are then applied on the fibers forming the fringe of the first strip, and this so that the fibers of the second strip overlap those of the first strip. Any excess thickness is thus avoided at that spot.

Another technique which may be used for connecting the strips consists in providing, on the strips, adjacent free edges along the zone of connection and a ribbon of predetermined width, which for example 5 or 10 cm, is unwound vertically along this zone. This ribbon is then glued on the support after connection along the whole zone of connection and the first strip is placed in in overlapping fashion on this ribbon so that it covers substantially half of the ribbon, and of that it is glued to the support and to the ribbon. The second adjacent strip is then placed edge to edge with the first strip, and on the other half of the ribbon, and is then glued to the support and to the ribbon. The subjacent ribbons thus provide waterproofing or seal in the zone of connection of two subjacent strips.

The surfacing according to the invention may be made by spraying droplets of resin on the fibrous substrate constituting the armature. This operation may be carried out by passing the armature under judiciously distributed spray nozzles producing jets of droplets. Means may be provided for varying the size of these droplets as well as their distribution in space, as a function of the relief which it is desired to obtain on the fibrous armature.

This spraying of droplets makes it possible to smooth the outer surface of the fibrous armature and it also prevents the fibers of this armature from emerging and thus retaining dirt. The droplets of resin determine the final relief of the outer surface of the armature: with fine droplets, a smooth surface is obtained, whilst with larger droplets, an average or very pronounced relief is obtained.

The armature constituted by a web of fabric or non-woven tissue, coated with droplets of resin projected whilst still in the liquid state, is then passed through a drying tunnel at a temperature of about 80° C. On leaving this tunnel, the armature is virtually dry and it is then wound on itself. Before winding, there is incorporated, on the armature pre-impregnated in this fashion, a sheet of colourless plastic material, for example a sheet of polyethylene 0.03 mm thick. This sheet of polyethylene is unwound from a roller and offers two advantages: it first prevents successive turns of the pre-impregnated armature from adhering to one another in the roller thus formed and, furthermore, during on-site operation, it protects the surfacing if there is a shower of rain.

BRIEF DESCRIPTION OF THE DRAWINGS

The invention will be more readily understood on reading the following description with reference to the accompanying drawings, in which.

DESCRIPTION OF THE PREFERRED EMBODIMENTS

Figure 1:
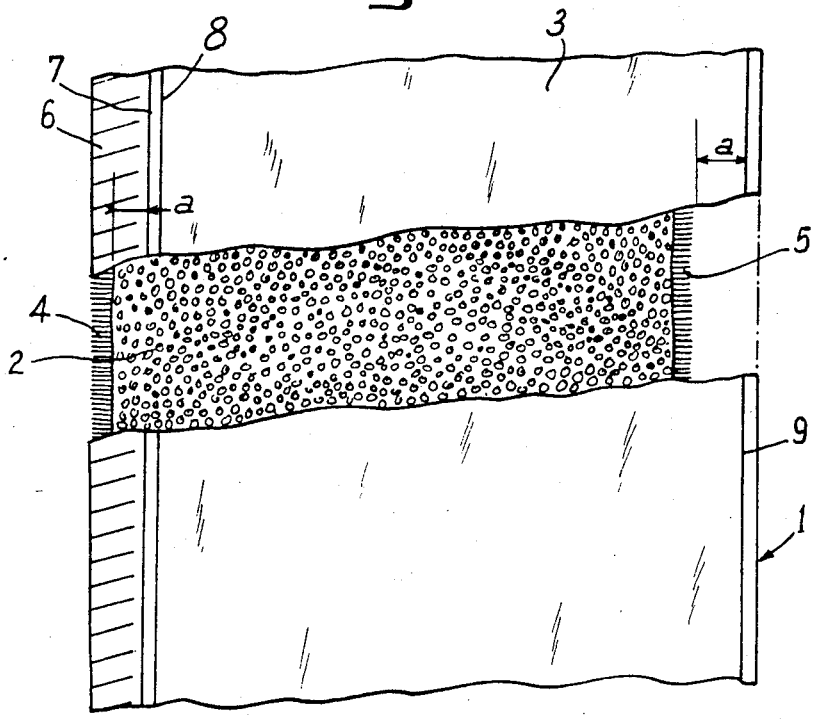
FIG. 1 is a view, in elevation, with parts torn away, of a strip constituting the waterproofing or sealing surfacing according to the invention.

Referring now to the drawings, FIG. 1 shows a strip 1 constituting the waterproofing or sealing surfacing according to the invention. This strip 1 comprises an armature made of a fibrous material, such as a woven fabric or non-woven tissue, which presents, on its outwardly turned surface, a discontinuous layer 2 giving a relief in the form of drops of water, constituted by dry resin droplets adhering to the surface of the armature and defining therebetween zones not covered by these droplets. On this layer 2 is applied a thin sheet 3 of plastics material, which constitutes a protective film adhering to the discontinuous layer 2 formed by the dry resin droplets and which may be easily detached from this layer 2 when the surfacing is applied on its support or the finishing layer on the armature.

To facilitate connection between the strips, fringes are provided on each selvage of the armature of a strip. FIG. 1 shows that the fibrous armature on which the layer 2 is formed is extended laterally, on each side, by successions of fringes, namely a set of left-hand fringes 4 and a set of right-hand fringes 5. These fringes, which are not covered with drops of resin and which are consequently free, extend from the armature in a transverse direction, i.e. substantially perpendicular to the longitudinal axis of the strip 1.

The thin sheet 3 of plastics material, constituting the protective film adhering to the subjacent layer 2, extends, on the left-hand side, up to the limit defined by the outer ends of the left-hand fringes 4. In this zone, the film 3 forms a band 6 marked by hatchings and which extends inwardly up to a first coloured longitudinal line 7, for example a blue line, this line being located at a predetermined distance a from the inner ends of the left-hand fringes 4, i.e., those by which these fringes are attached to the impregnated fibrous armature. The line 7 also defines a line of least resistance constituted for example by a succession of perforations, to facilitate detachment of the hatched side band 6. In the immediate vicinity of this first line 7 there extends a second longitudinal line 8 parallel thereto.

On the right-hand side, the protective film 3 made of plastics material extends beyond the outer ends of the right-hand fringes 5, and on this protective film is traced, near its edge, a line 9 of colour different from that of lines 7, 8, for example red. This line is located at distance a from the outer ends of the right-hand fringes 5.

The mode of using the surfacing which has just been described will now be described with particular reference to FIGS. 2 to 7.

Figure 2:
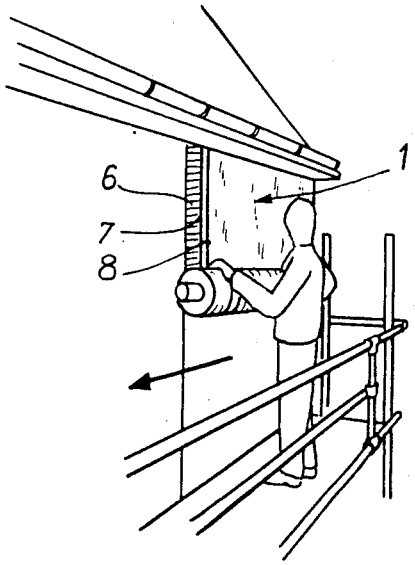
FIGS. 2 to 7 are views, in perspective, illustrating the different phases of laying the strips comprising the surfacing according to the invention.
Figure 3:
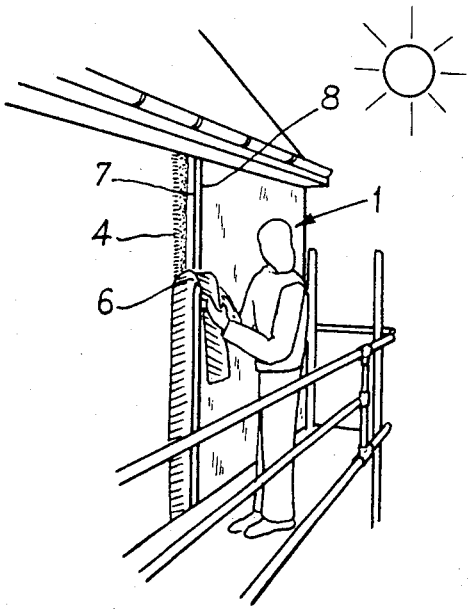
Figure 4:
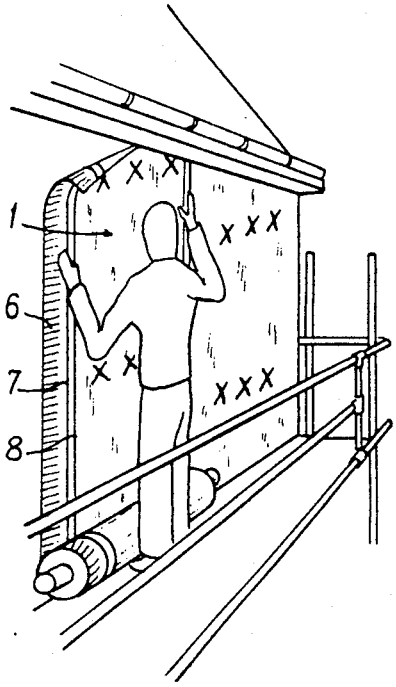
Figure 7:
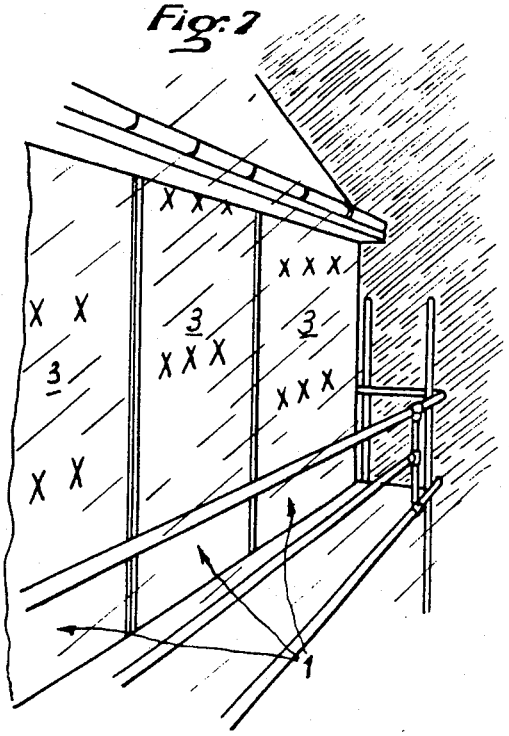
Figure 5:
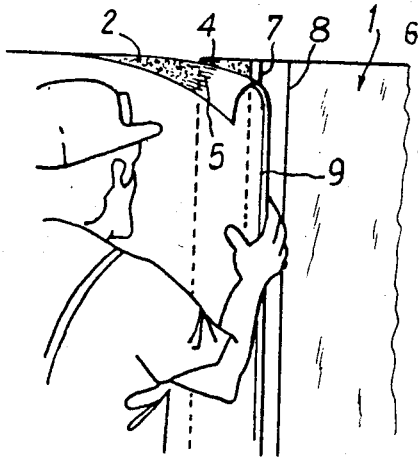
Figure 6:
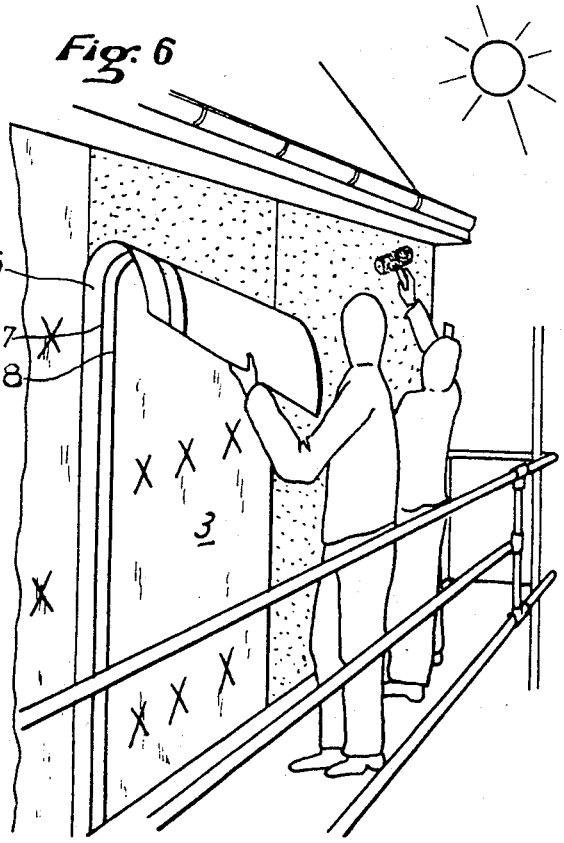

After having coated with glue the support, such as the wall of a dwelling on which the surfacing according to the invention is to be applied, the strip 1 provided with its protective film 3 is unwound, applying the armature of fibrous material on the layer of glue previously deposited. This operation is schematically shown in FIG. 2. If the weather is fine and there is no risk of rain, the hatched marginal band 6 of the protective film 3 which protects the left-hand fringes 4 is then eliminated (FIG. 3). These fringes are then placed perpendicularly to the strip 1 in order subsequently to obtain a discrete overlapping between adjacent strips. A cutter or scissors is then used for cutting out any windows, brackets, cable passageways, etc.

A layer of glue is then applied at the place intended for the second strip having to lie to the left of the first strip which has already been laid. This second strip comprises, on its right-hand side, the vertical line 9 printed in red on the protective film 3. Furthermore, the first strip already laid comprises on its left-hand side the two adjacent, parallel blue lines 7, 8. It then suffices to unwind the second strip located to the left by placing its red line 9 between the two blue lines 7, 8 of the previous strip (FIGS. 4 and 5) for correct overlapping of the right-hand fringes 5 of the second strip and of the left-hand fringes 4 of the first strip.

If a very careful overlapping is desired, the red line 9 of the second strip and the left-hand blue line 7 of the first strip are brought into register.

The third strip is then placed in the same way and, if the weather is still fine, the protective film 3 of the first strip is removed as the third strip is unwound.

On the other hand, in the event of rain, the protective film of each strip 1 is left in place (FIG. 7) until the weather improves.

What I claim is:

1. A waterproofing or sealing surface adapted to be attached to the facade of a building, said surface comprising a layer of fibrous material adapted to be adhered to the facade, said material having an inner face, an outer face, and a resin on said inner face, said resin comprising means for attaching said layer to the facade of said building, said surface having on said outer face a discontinuous layer comprising a plurality of dried resin droplets which are adhered to the outer face of said fibrous material, a plurality of zones not covered by said droplets being located between said droplets, said surface further comprising a protective film in the form of a thin layer of plastic material adhered to said discontinuous layer formed by said dry resin droplets, said thin layer of plastic material comprising means for easily detaching said thin layer from the layer of resin droplets after said fibrous material layer is attached to said facade, said droplets thereby forming a decorative exterior face for said surface after said thin layer of plastic material is detached from said layer of fibrous material, said fibrous material layer having two opposed parallel sides, each of said parallel sides including a plurality of relatively thin strands of fibrous material extending outwardly from said opposed sides in a substantially perpendicular fashion to the longitudinal axis of said fibrous material layer.

2. A waterproofing or sealing surface in accordance with claim 1 wherein said fibrous material layer comprises a woven fabric.

3. A waterproofing or sealing surfacing in accordance with claim 1 wherein said fibrous material layer comprises a non-woven tissue.

4. A waterproofing or sealing surface adapted to be attached to the facade of a building, said surface comprising a layer of fibrous material adapted to be adhered to the facade, said fibrous material having an inner face, an outer face, and a resin on said inner face, said resin comprising means for attaching said layer to the facade of said building, said surface having on said outer face a discontinuous layer comprising a plurality of dried resin droplets adhered to the outer face of said fibrous material, a plurality of zones not covered by said droplets being located between said droplets, said surface further comprising a protective film in the form of a thin layer of plastic material adhered to said discontinuous layer formed by said dry resin droplets, said thin layer of plastic material comprising means for easily detaching said thin layer from the layer of resin droplets after said fibrous material layer is attached to said facade, said fibrous material comprising a layer having two opposed parallel sides, said layer further comprising two fringe sets, each of said fringe sets comprising a plurality of fringes which are unimpregnated with dry resin droplets, the fringes in each of said fringe sets extending parallel to each other and in a substantially perpendicular fashion to the longitudinal axis of said fibrous material layer, each of said fringe sets extending from one of said parallel sides.

5. A waterproofing or sealing surface in accordance with claim 4 wherein a portion of said thin sheet of plastic film is adapted to extend over one set of said fringes of said fibrous material layer said film portion extending to free edges of said fringes in said one set, said film portion forming a band extending from a first side edge of said film to a first colored line parallel to said first side edge, said first line being positioned at a predetermined distance from a line formed by the points of attachment of fringes in said one set to one side of said fibrous layer, wherein first line comprises means for indicating to a user a line of minimum resistance for detaching said protective film from said fibrous material layer.

6. A waterproofing or sealing surface in accordance with claim 5 wherein said protective film further comprises a second longitudinal line substantially parallel to said first line, said protective film extending along a second side edge of said protective film opposite to said first side edge of said protective film beyond a second set of fringes attached to the other side of said fibrous material, said protective film comprising a third line spaced from free edges of said second set of fringes by a distance which is equal to said predetermined distance.

7. A waterproofing or sealing surface adapted to be attached to the facade of a building, said surface comprising:

(a) a layer of fibrous material having opposed first and second parallel sides, an inner face, and an outer face;

(b) first and second sets of fringes attached to said first and second sides, respectively, said fringes having free ends and ends which are attached to said sides;

(c) a plurality of dried resin droplets on said outer layer face, and a plurality of zones on said outer layer face which are not covered by said droplets;

(d) a thin cover protective sheet formed of plastic film, said film having an outer surface and inner surface detachably connected to said droplets, said film further comprising opposed, parallel first and second side edges, said first side edge extending to the free ends of said first set of fringes, second side edge extending beyond said second set of fringes, said cover sheet further comprising at least first and second indicia lines on said outer surface, said first and second lines being parallel to said first and second side edges, said first line being spaced from a line formed by the attachment of the ends of said first set of fringes to said first layer side by a predetermined distance, said second line being spaced from said second side by a distance equal to said predetermined distance, said first line comprising means for indicating to a user a line of minimum resistance for initiating detachment of said film from said fibrous layer.

* * * * *